United States Patent [19]

Middleton

[11] 4,411,234

[45] Oct. 25, 1983

[54] FUEL SYSTEM FOR INTERNAL COMBUSTION ENGINE

[75] Inventor: Harold G. Middleton, Seattle, Wash.

[73] Assignee: Advanced Fuel Systems, Seattle, Wash.

[21] Appl. No.: 207,693

[22] Filed: Nov. 17, 1980

[51] Int. Cl.[3] ..... F02D 5/02

[52] U.S. Cl. ..... 123/485; 123/179 L; 123/337; 123/400; 123/491; 123/494; 73/204

[58] Field of Search ..... 123/472, 475, 478, 483, 123/484, 485, 488, 491, 494, 333, 376, 400, 337, 395, 179 L; 73/204

[56] References Cited

U.S. PATENT DOCUMENTS

| | | | |
|---|---|---|---|
| 1,568,410 | 1/1926 | Minter | 123/337 |
| 2,104,649 | 1/1938 | Hinton | 123/395 |
| 3,680,532 | 8/1972 | Omori | 123/491 |
| 3,747,577 | 7/1973 | Mauch et al. | 123/494 |
| 3,749,070 | 7/1973 | Oishi et al. | 123/485 |
| 3,796,198 | 3/1974 | Mauch et al. | 123/483 |
| 3,812,830 | 5/1974 | Traisnel | 123/491 |
| 3,999,525 | 12/1976 | Stumpp et al. | 123/491 |
| 4,184,460 | 1/1980 | Harada et al. | 123/483 |
| 4,193,300 | 3/1980 | Peter | 73/204 |
| 4,205,377 | 5/1980 | Oyama et al. | 123/494 |
| 4,232,647 | 11/1980 | Van Siclen, Jr. | 123/483 |
| 4,264,961 | 4/1981 | Nishimura et al. | 123/494 |

*Primary Examiner*—Charles J. Myhre
*Assistant Examiner*—Andrew M. Dolinar
*Attorney, Agent, or Firm*—Seed and Berry

[57] ABSTRACT

A fuel system for an internal combustion engine includes a fuel processing unit having at least one foot-actuated, split butterfly valve for controlling induction airflow and a plurality of fuel injectors for spraying fuel into the induction airflow. The split butterfly valve in the fuel processing unit includes a pair of butterfly flaps which rotate in opposite directions in response to throttle movement to insure symmetry of induction airflow through the unit. The butterfly valve is connected to the throttle by a tangential linkage which gradually increases the rate of valve opening responsive to throttle movement to provide smooth response characteristics. The fuel is injected at a temperature and pressure drop selected to produce flash vaporization of the major portion of the fuel in order to promote complete combustion. The injectors are actuated by a control circuit which receives and processes a variety of signals indicative of engine performance and demand, such as engine speed, engine timing, coolant water temperature, mass flow of induction air, and manifold absolute pressure. The mass flow of induction air is measured by a sensing system having a sensing wire positioned in the induction airstream. A current flowing through the sensing wire is automatically adjusted to maintain the temperature of the sensing wire constant. The resistance of the wire is directly proportional to its temperature so that a measurement of the current through the wire is an indication of the mass flow of induction air.

14 Claims, 14 Drawing Figures

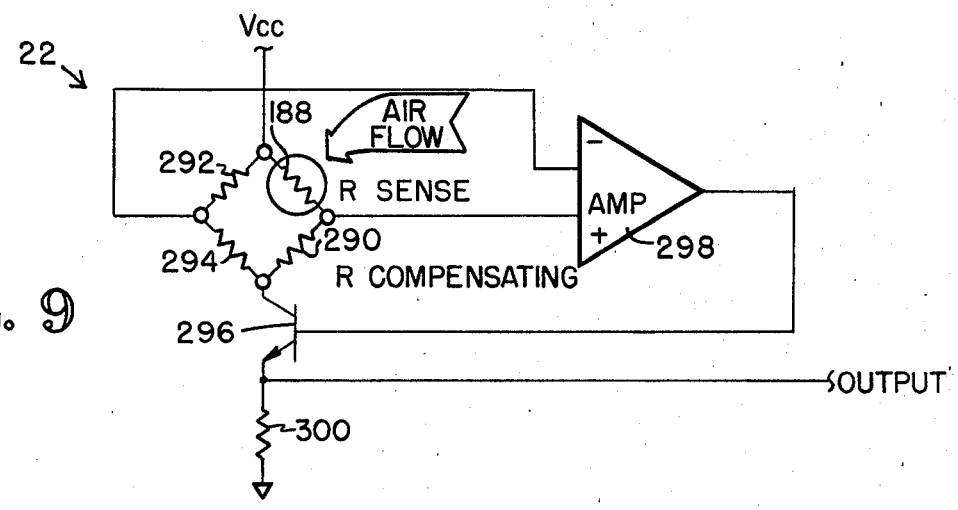
FIG. 9
FIG. 10
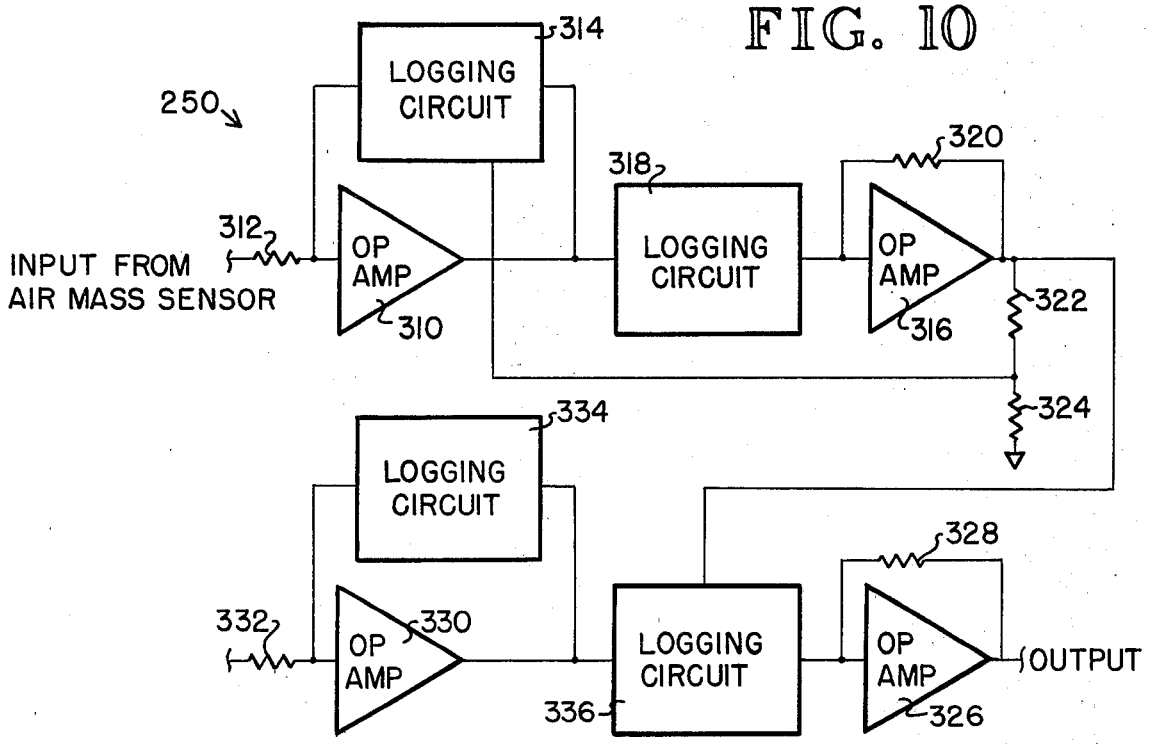
FIG. 11
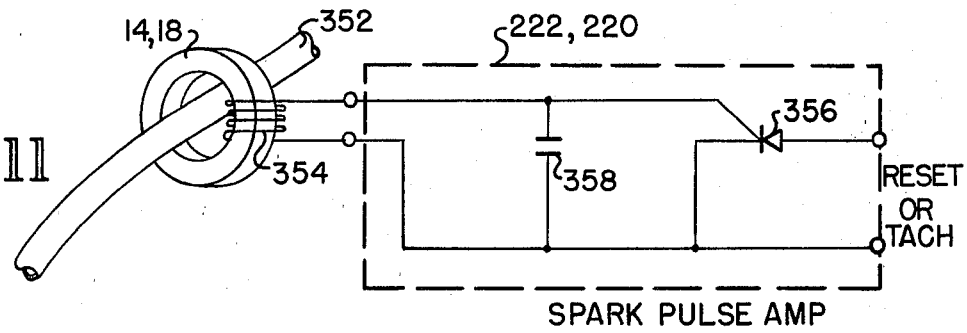

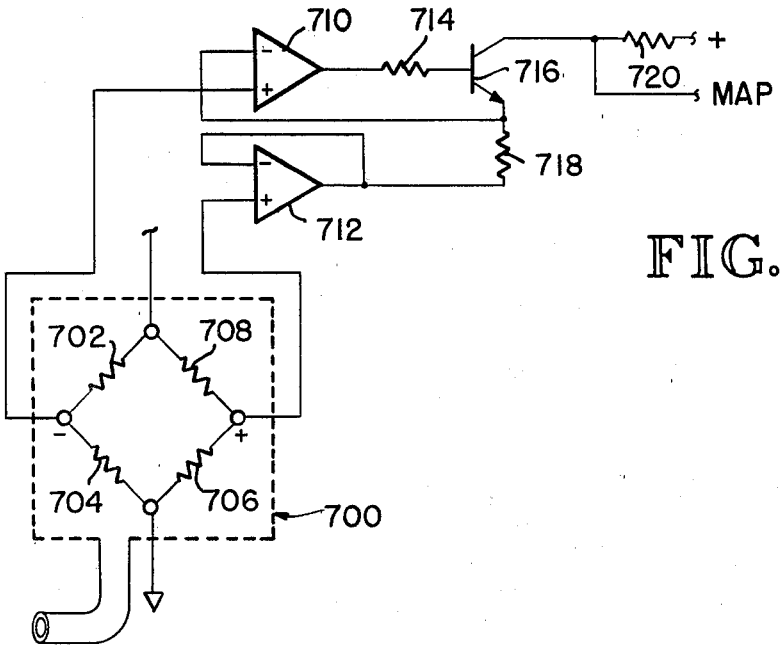
FIG. 12 B
FIG. 12 C
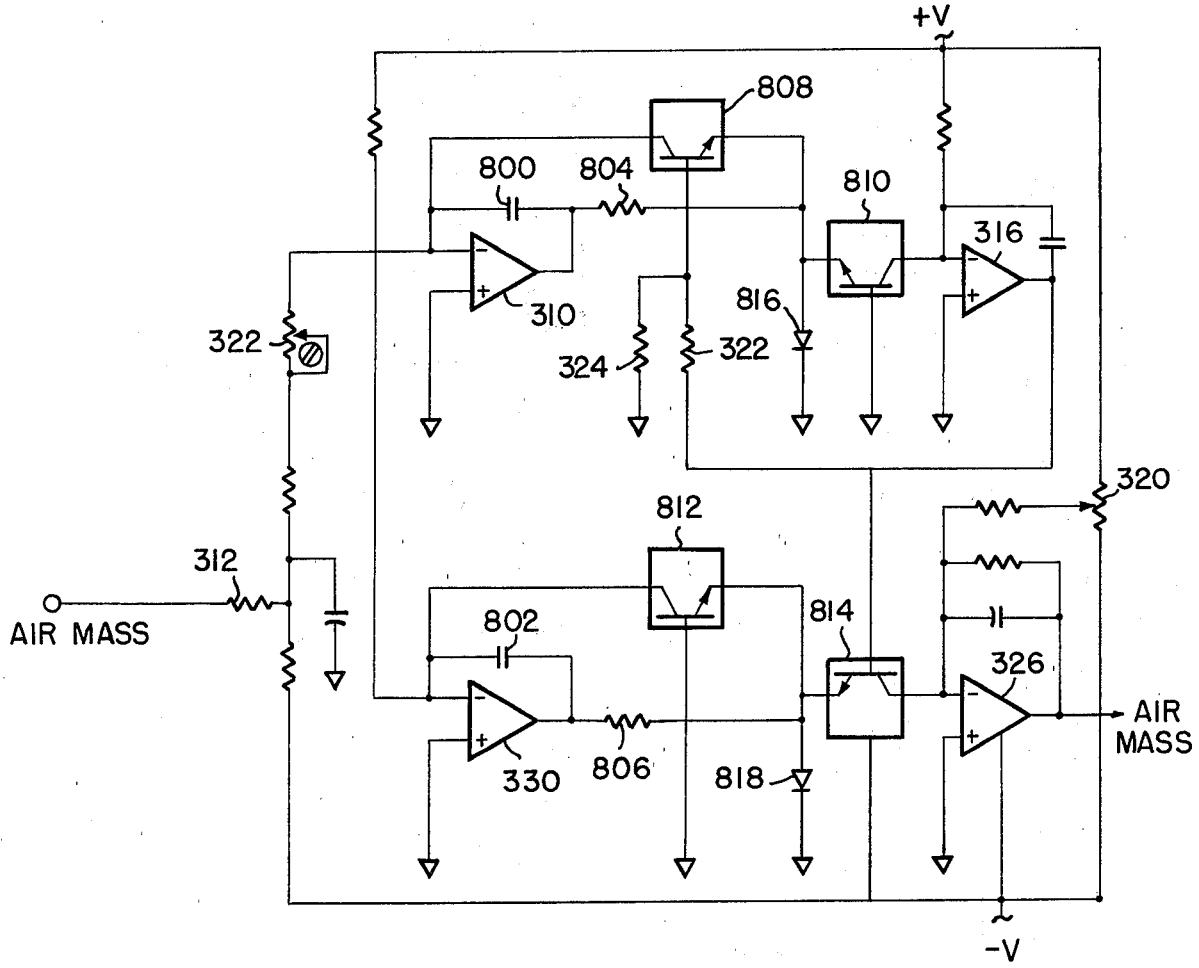

FUEL SYSTEM FOR INTERNAL COMBUSTION ENGINE

DESCRIPTION

1. Technical Field

This invention relates to internal combustion engines, and more particularly, to a system for generating a fuel control signal from sensed conditions and for injecting fuel into induction air under flash vaporization conditions in response to the control signal, and also to a fuel processing unit that promotes symmetrical induction airflow and smooth response characteristics.

2. Background Art

Internal combustion engines burn a fuel and air mixture which is generally formed either by continuously injecting fuel into induction air passing through a venturi or by periodically injecting fuel directly into the cylinders in a predetermined sequence. Attempts have also been made to inject fuel either continuously or periodically at other points in the induction air supply system, such as above or below the induction air butterfly valves or in the intake manifold.

Regardless of which mixing technique is employed, it is highly advantageous to achieve complete mixing of the air and fuel in order to promote complete combustion of the fuel in the cylinders. Attempts to provide complete mixing have generally relied on spraying the fuel into the induction air in the form of a mist composed of very small droplets. While minimizing the size of the droplets is somewhat effective in promoting good air-fuel mixing, the technique is nevertheless not entirely satisfactory. As a result, the efficiency in miles per gallon of modern internal combustion engines is unduly limited.

Conventional fuel mixing devices, such as carburetors, also exhibit other shortcomings which affect the efficiency of internal combustion engines. For example, the flow of induction air into the carburetor is generally controlled by a butterfly valve, which is essentially a circular flap having a shaft extending across its diameter. The butterfly valve is opened to increase induction airflow by rotating the shaft, causing one side of the flap to move in the direction of airflow while the other flap moves in the opposite direction. As a result, the flow of air through the carburetor is not symmetrical, and localized variations exist in the mixing of the fuel with induction air. The shaft on which the butterfly valve is mounted is generally connected to a foot-controlled throttle through a linkage which rotates the shaft in proportion to throttle movement. The increase in induction airflow produced by this mechanism is a non-linear function of the throttle position so it is difficult to smoothly increase engine power. As a result, excessive acceleration of the vehicle often occurs inadvertently, which further detracts from the efficiency of the engine.

DISCLOSURE OF INVENTION

It is an object of the invention to inject fuel into induction air at a temperature and pressure which causes flash vaporization of all but the least volatile components of the fuel, thereby achieving optimum mixing of the fuel in order to promote complete combustion.

It is another object of the invention to provide an electronic device employing analog circuitry for injecting precisely controlled quantities of fuel into the induction air on the basis of a large number of sensed conditions.

It is another object of the invention to measure the mass flow of induction air entering the engine in a manner which is accurate over all operating ranges and is capable of quickly responding to variations in flow rate.

It is a further object of the invention to provide a linkage system for connecting a throttle to a butterfly valve which gradually increases the rate of butterfly valve movement responsive to actuation of the throttle.

These and other objects of the invention are provided by a fuel system for an internal combustion engine having a fuel processing unit injecting fuel in the induction airflow in accordance with a number of sensed operating conditions. The fuel is injected at a temperature and a pressure that causes flash vaporization of all but the least volatile components of the fuel. Flash vaporization injection optimizes mixing of the fuel with the induction air in order to promote complete combustion of the fuel. The quantity of fuel injected is determined by the duration of a fuel quantity signal which is inversely proportional to the engine's temperature and rotational velocity, and directly proportional to the mass flow of induction air and the manifold absolute pressure. The induction air mass flow is measured by a sensing device placed in the induction airflow. The device, which has a resistance proportional to its temperature, receives an electric current which is automatically adjusted to maintain a constant temperature. The current is thus a measure of the mass flow of induction air. The fuel processing unit includes a split butterfly valve for controlling the induction airflow in a manner which produces symmetrical flow of the induction air. The fuel processing unit includes a shaft-mounted butterfly valve for controlling the induction airflow. The shafts are interconnected to rotate in opposite directions, thereby causing symmetrical opening of the flaps. The shaft is rotated by a linkage system which causes the rate at which the butterfly valves open to increase gradually with increasing throttle movement in order to smoothly increase the flow of induction air to the engine.

BRIEF DESCRIPTION OF THE DRAWINGS

FIG. 9 is a schematic of a circuit of the air mass sensor.

FIG. 10 is a block diagram of a circuit for generating a signal indicative of the log of the air mass sensor output.

FIG. 11 is a schematic of a spark pulse amplifier for generating a trigger signal in synchronism with an ignition spark.

BEST MODE FOR CARRYING OUT THE INVENTION

Figure 1:
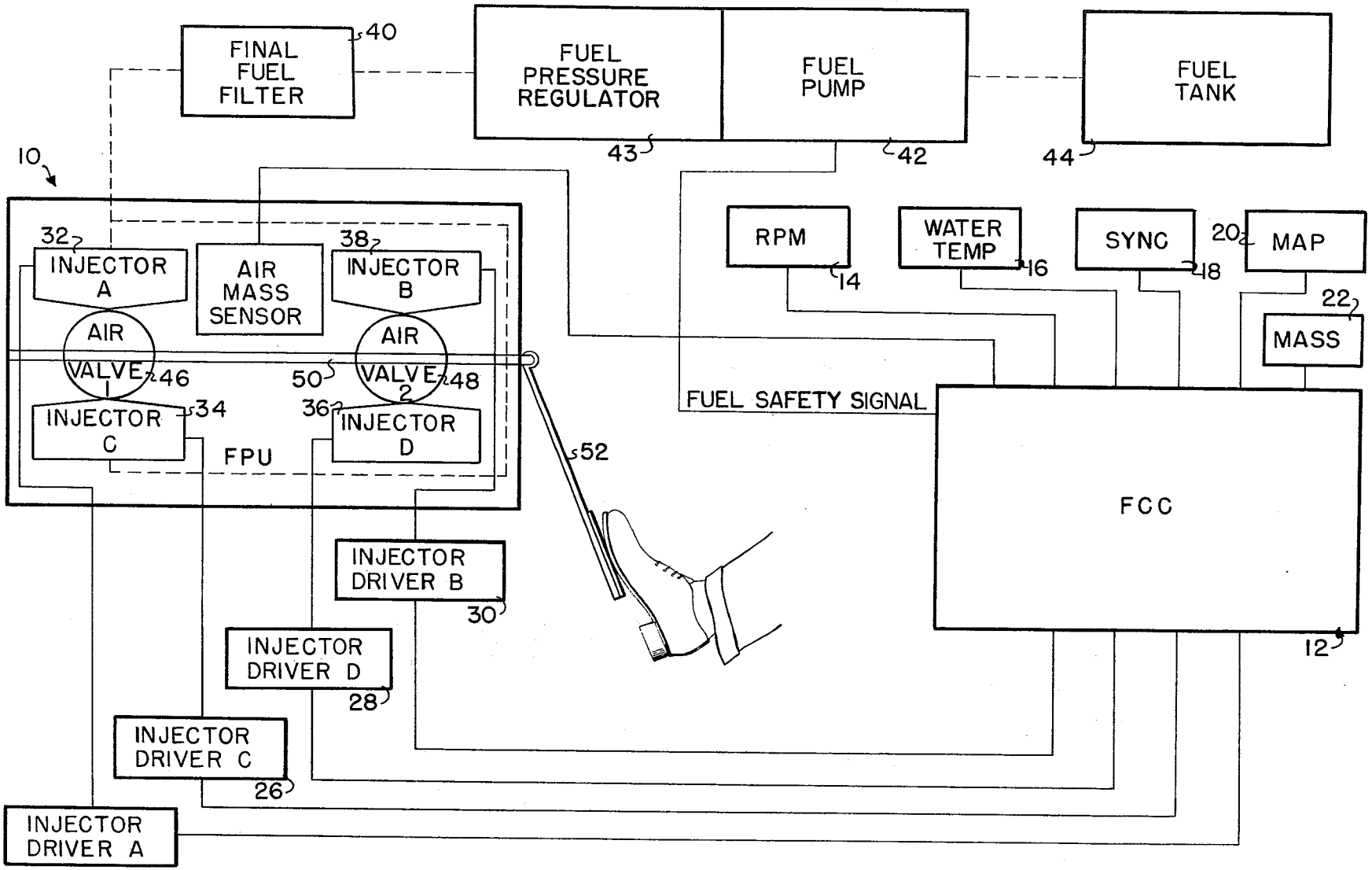
FIG. 1 is a block diagram of the fuel supply system.

The inventive fuel system, as illustrated in FIG. 1, includes two basic components, namely, a fuel processing unit 10 and a fuel control circuit 12. The fuel control circuit 12 receives inputs from an RPM sensor 14, a coolant water temperature sensor 16, a synchronizing circuit 18, a manifold absolute pressure sensor 20, and an induction air mass sensor 22, and generates appropriate signals for actuating fuel injector driver circuits 24,26,28,30. The driver circuits 24–30 supply respective signals to injectors 32,34, 36, 38 and the fuel processing unit 10. The injectors receive fuel from a filter 40 which has been pressurized by a conventional pump 42 and regulated by pressure regulator 43 after being withdrawn from a fuel tank 44.

The induction air into the fuel processing unit 10 is controlled by one or more butterfly valves 46,48 operated by a common set 50 of control shafts 50 which are connected to a foot-actuated throttle 52 by a tangential linkage, as explained in greater detail hereinafter.

Figure 2:
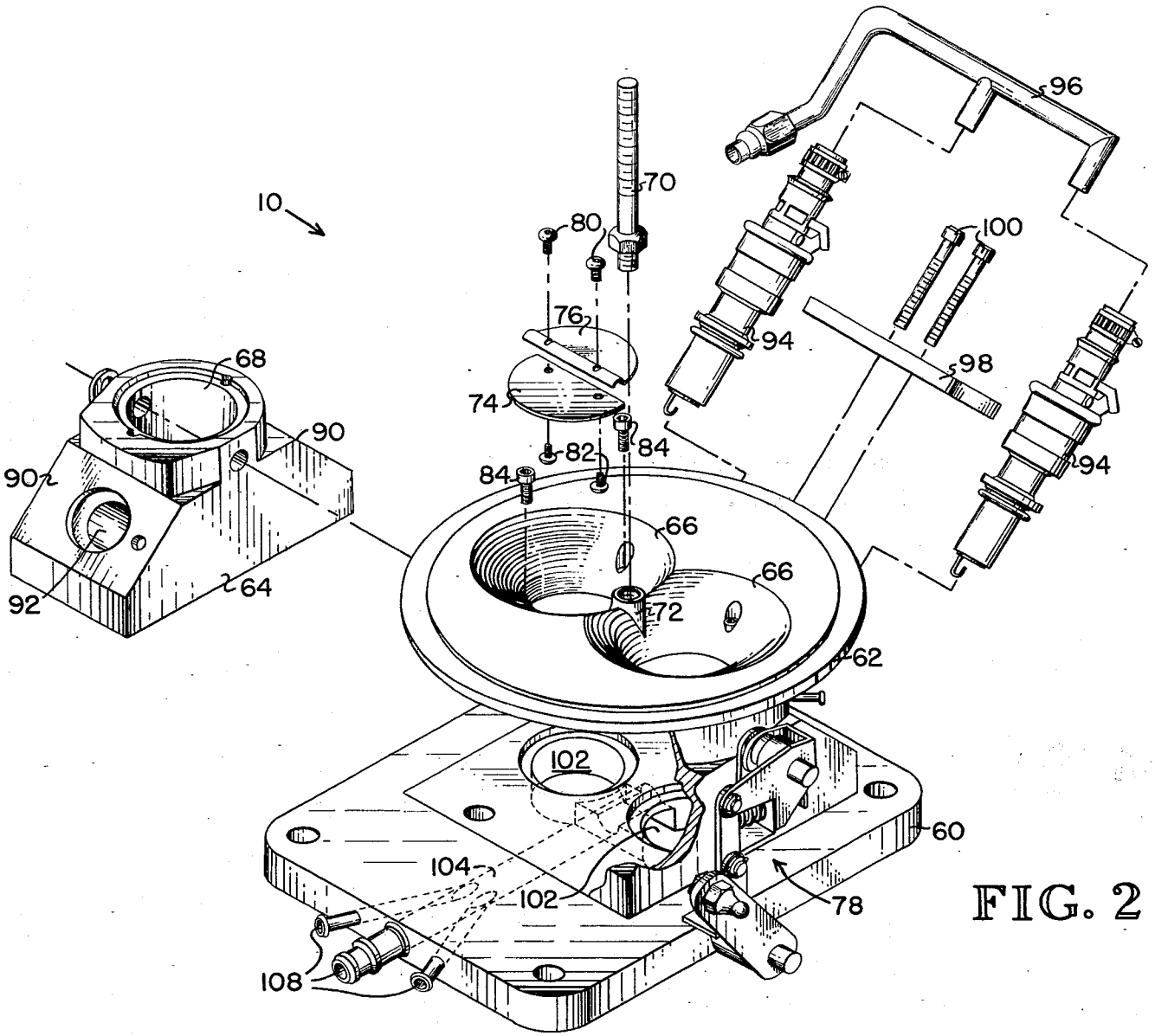
FIG. 2 is an exploded isometric view of the fuel processing unit which controls induction airflow and injects fuel into the induction airstream.

With reference now to FIG. 2, the fuel processing unit 10 includes a base 60, a generally circular intake 62, and one or more body portions 64 positioned between the base 60 and intake 62. The intake 62 has formed therein one or more conical inlets 66 positioned adjacent each other which are concentric with respective inlets 68 formed in the body portion 64. A mounting shaft 70 is threaded into a boss 72 between the inlets 66 for supporting a conventional air filter and inlet structure.

The flow of induction air through the inlets 66, 68 is controlled by a butterfly valve described in greater detail hereinafter. The butterfly valve includes a pair of valve portions 74,78 which are mounted on a shaft (shown hereinafter) by respective pairs of screws 80,82. Another pair of screws 84 secure the inlet 62 to the body portion 64.

The body portion 64 has formed therein a pair of inclined surfaces 90, each containing a bore 92 for receiving a respective injector 94. The injectors 94 receive pressurized fuel through a conduit 96 and inject the fuel into the inlet 68 beneath the butterfly valve portions 74, 78. The pressure drop of the fuel at its ambient temperature is sufficient to cause all but the least volatile components of the fuel to instantly vaporize in the inlet 68, thereby promoting complete mixing and hence complete combustion of the fuel. The injectors 94 are held in place by a plate 98 which is secured to the body portions 64 by a pair of screws 100.

Multiple fuel injectors 94 are used because their response time is too slow for a single injector 94 to open and close for each cylinder and their flow rate is too low. Thus the embodiment illustrated herein is adopted for an eight-cylinder engine, and each injector 94 supplies fuel for two cylinders. Faster fuel injectors 94 with higher flow rates or fewer cylinders would allow a reduction in the number of injectors 94 that are required.

The base 60 has formed therein one or more cylindrical bores 102 which are concentric with the inlets 68 and thus form an extension thereof. An internal passage 104 in the base 60 connects the bores 102 to three vacuum ports 108 connected to other parts of the engine, such as the positive crankcase ventilation valve, as is conventional with internal combustion engines. The fuel processing unit 10 thus controls the flow of induction air through the unit responsive to movement of the butterfly valve portions 74,76, and it mixes fuel metered by the injectors 94 with the induction air.

Conventional carburetors generally control the flow of induction air with a single butterfly valve instead of the two separate valve portions 74,76 illustrated in FIG. 2. As the shaft on which the valve is mounted rotates, one side of the valve moves upwardly toward the venturi entrance while the other side of the flap moves downwardly, away from the venturi entrance. It is intuitively obvious that the valve will direct more air through one side of the venturi than the other, thus causing uneven mixing of the fuel and air.

Figure 3:
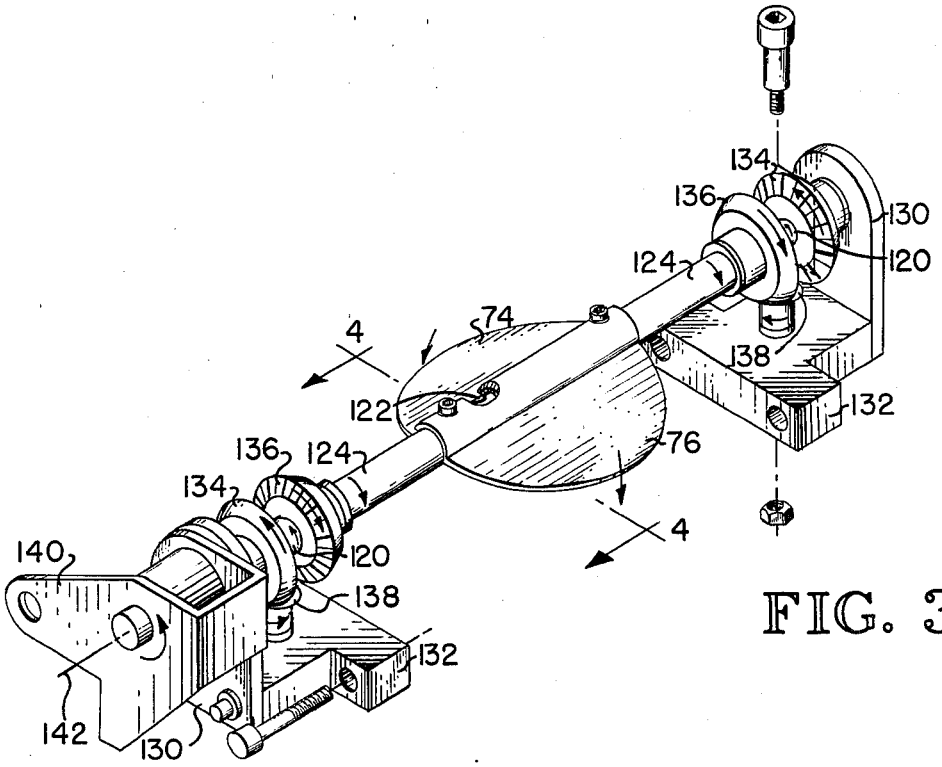
FIG. 3 is an isometric view of a split butterfly valve used in the fuel processing unit of FIG. 2.
Figure 4:
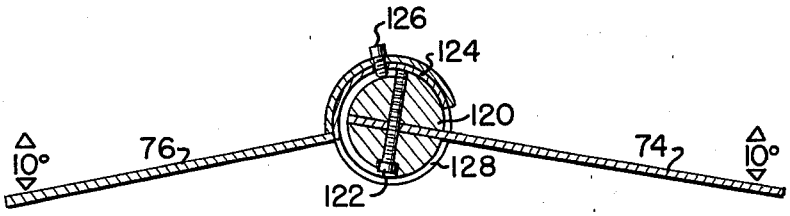
FIG. 4 is a cross-sectional view taken along the line 4—4 of FIG. 3.

With reference also now to FIGS. 3 and 4, the inventive split butterfly valve inherently achieves symmetrical induction airflow by rotating both valve portions 74, 76 downwardly, away from the inlet opening. Accordingly, valve portion 74 extends through a slot in an inner shaft 120 and is secured thereto by a screw 122 while the other valve portion 76 is mounted on the outside of an outer shaft 124 by screws 126. A cutout 128 is formed in the outer shaft 124 adjacent valve portions 74,76 to allow the valve portion 74 to pivot without interference from the outer shaft 124.

The inner shaft 120 is rotatably mounted in supports 130 projecting upwardly from respective bases 132. A bevel gear 134 is mounted on each end of the inner shaft 120, and a like bevel gear 136 is mounted on each end of the outer shaft 124. The bevel gears 134,136 mesh with a pair of beveled idler gears 138 so that rotation of the inner shaft gears 134 in one direction causes rotation of the outer shaft bevel gears 136 in the opposite direction. Thus rotation of the inner shaft 120 in the direction indicated causes the valve portion 74 to pivot downwardly, and it also causes the outer shaft 124 to pivot the valve portion 76 downwardly. An actuating link 140 is fixedly mounted on one end of the inner shaft to actuate the butterfly valve portions 74,76.

Figure 5:
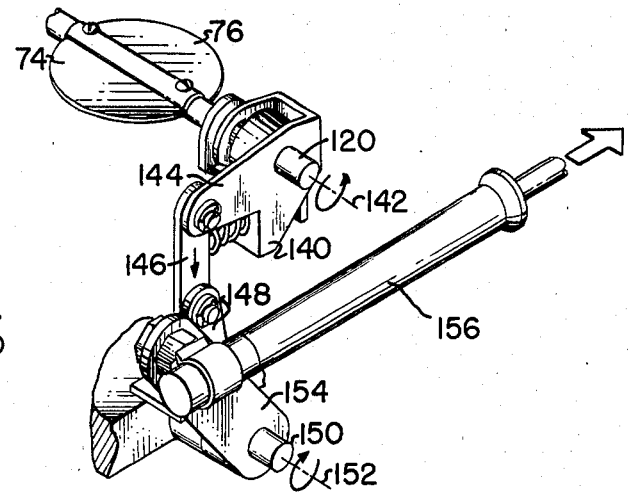
FIG. 5 is an isometric view of a mechanical linkage for gradually increasing the rate of the opening of the butterfly valve responsive to throttle movement.

Referring now to FIG. 5, the actuating link 140 rotates about an axis 142 which is coincident with the shaft 120. As illustrated in FIG. 5, a horizontal projection 144 of the actuating link 140 is pivotally secured to one end of a link 146. The other end of the link 146 is pivotally secured to an actuating member 148. The actuating member 148 extends from a shaft 150 which is rotatably mounted about axis 152. An actuating link 154, also mounted on the shaft 150, is pivotally connected to a throttle actuating rod 156 connected to the throttle pedal illustrated in FIG. 1. Movement of the actuating rod 156 in the direction indicated causes the shaft 150 to rotate as illustrated, thereby producing downward movement of the link 146, which causes the shaft 120 to rotate the axis 142 of the shaft 120 in the direction illustrated in FIG. 5.

Figure 6:
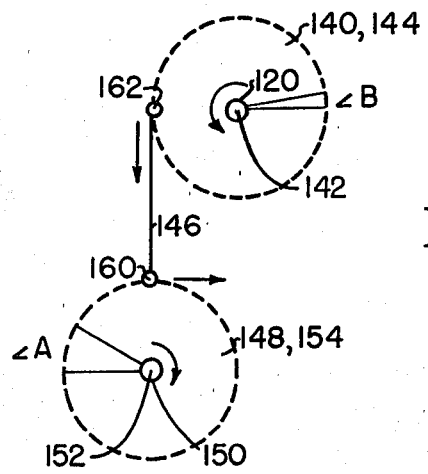
FIG. 6 is a schematic illustrating the theory of operation of the throttle linkage of FIG. 5.

Rotation of the shaft 150 responsive to movement of the actuating rod 156 initially produces relatively little rotation of the shaft 120. However, further rotation of the shaft 150 causes a proportionately greater rotation of the shaft 120 as the shaft 150 continues to rotate. As more clearly shown in FIG. 6, as the shaft 150 initially rotates, the lower end 160 of the link 146 moves horizontally. This horizontal movement of point 160 causes relatively slight downward movement of the upper end 162 of the link 146. In other words, the horizontal movement of the lower end 160 is significantly larger than the downward vertical movement of the upper end 162. Consequently, the rotation of shaft 120 is considerably less than the rotation of the shaft 150. Thus the butterfly valve opens only slightly responsive to initial actuation of the throttle. However, as the shaft 150 continues to rotate responsive to throttle movement, the movement of the upper end 162 approaches the movement of the lower end 160 and, after 45 degrees of rotation of shaft 150, even surpasses the rotation of the shaft 150. The inventive linkage system thus promotes the smooth increase of engine power, which avoids excessive acceleration and promotes fuel economy.

Figure 7:
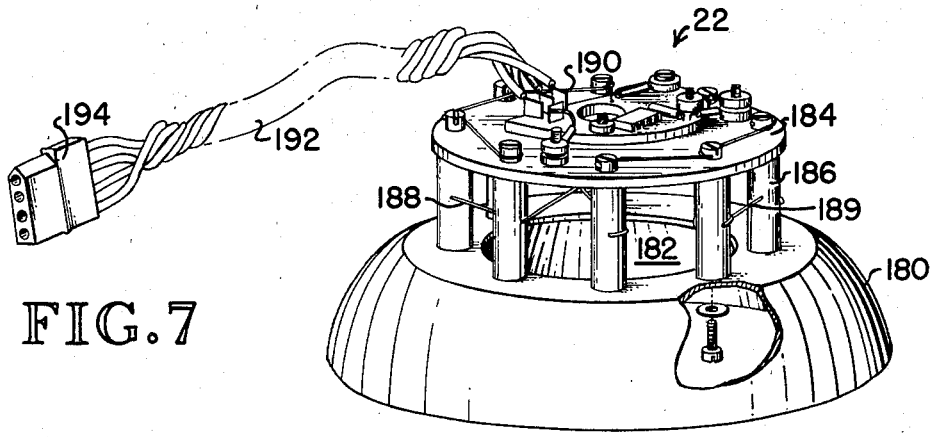
FIG. 7 is an isometric view of a device for sensing the mass of induction air entering the fuel processing unit.

The sensor 22 for measuring the mass flow of induction air entering the fuel processing unit 10 is illustrated in FIG. 7. The sensor 22 includes a generally cylindrical base 180 having a diameter approximately equal to the diameter of the air inlet 62 illustrated in FIG. 2. The base 180 is adapted to fit over the air inlet 62, allowing air to enter the throat inlets 66 through a cutout 182 in the base 180. A generally circular circuit board 184 is mounted over the cutout 182 by a plurality of circumferentially spaced supports 186. A sensing wire 188 is strung between the supports 186 so that air flowing into the inlet through the opening 182 flows past the wire 188. A second wire 189, which has the same temperature-induced resistance characteristics as wire 188, is placed in the induction airstream to compensate for change in ambient temperature of the incoming air. The wire 189 is not heated by the current flowing through it so it does not respond to the flow of induction air. Appropriate circuitry 190, illustrated in greater detail hereinafter, automatically regulates the flow of current through the wire 188 to maintain the temperature of the wire constant. The circuitry 190 also generates a voltage indicative of the current through the wire 188 and compensates for variations in the temperature of the induction air. The current is thus proportional to the mass of air flowing through the opening 182. The circuitry 190 is connected to the fuel control circuit 12 through wires 192 and a conventional connector 194. Although the mass airflow sensor 22 has been described for use with the inventive fuel processing unit 10, it will be understood that it may be used for measuring the mass flow of induction air for carburated internal combustion engines, turbocharged internal combustion engines, or internal combustion engines employing other types of fuel systems. Also, although a wire 188 is shown herein as being the mass flow sensing element, it will be understood that other types of sensing elements may also be used.

Figure 8:
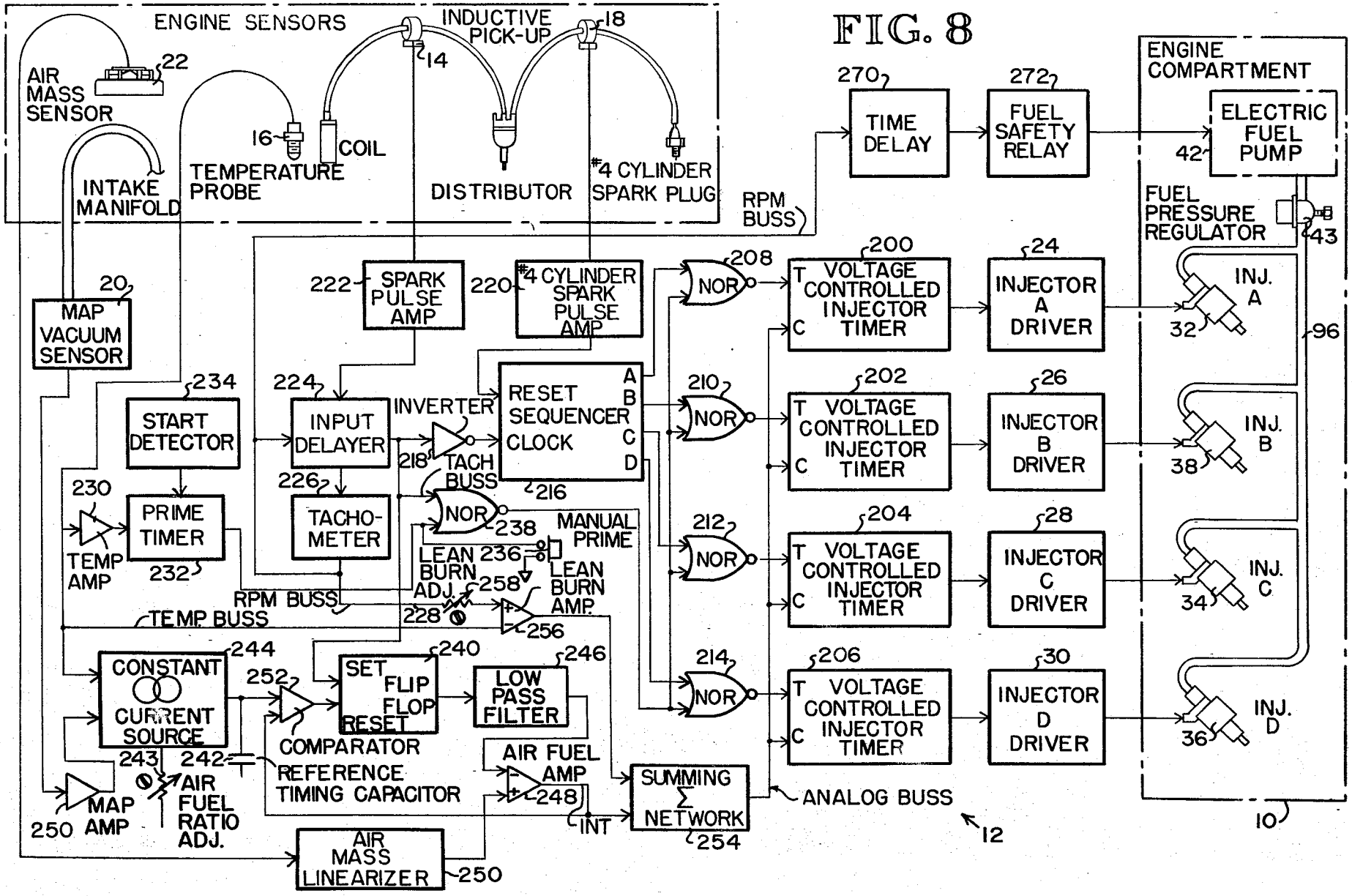
FIG. 8 is a block diagram of the fuel control circuit for injecting precise quantities of fuel into the induced airstream on the basis of a number of sensed operating conditions.

A block diagram of the fuel control circuit is illustrated in FIG. 8. As explained above in reference to the system block diagram of FIG. 1, and in the detailed description of the fuel processing unit 10, fuel is injected into the fuel processing unit 10 by four conventional fuel injectors 32,38,34,36 when actuated by respective injector drivers 24,26,28,30. The fuel is conveyed to the injectors 32–38 through a conduit 96 from the pressure regulator 43 and fuel pump 42 (FIG. 1). Each injector 24–30 is driven by a respective voltage-controlled injector timer 200,202,204,206 having a trigger input "T" and a control input "C." When the injector timers 200–206 receive a pulse at their trigger input, they generate an output pulse having a duration determined by the magnitude of the voltage at the control input.

The voltage-controlled injector timers 200–206 are triggered by signals generated by respective NOR gates 208, 210,212,214. The NOR gates each have two inputs, one of which is common to all gates 208–214 and the other of which is connected to a respective output from a sequencer 216. The sequencer 216 is basically a shift register having its low-order bit initially set high so that a logic high is sequentially applied to the NOR gates 208–214 responsive to clock pulses from inverter 218. The shift register 216 is reset by a pulse from the spark pulse amplifier 220 for the last cylinder in the firing order when the spark plug for that cylinder is fired, as detected by sensor 18. A similar spark pulse amplifier 222 receives pulses from a sensor 14 each time a high-voltage pulse is applied to the distributor. For a four-cylinder engine, the spark pulse amplifier 220 thus generates one pulse for every four pulses generated by the spark pulse amplifier 222. The output of the spark pulse amplifier 222 is applied to an input delayer circuit 224 which triggers the sequencer 216 through the inverter 218 for a predetermined period after the pulse from the spark pulse amplifier 222 is received. The spark for that last cylinder in the firing order is chosen to reset the sequencer 216 so that the NOR gate 208 for injector A is actuated a predetermined period after the spark for the last cylinder, as determined by output delayer 224. Since the spark plug for the first cylinder in the firing order is fired after the spark plug for the last cylinder, the injector timer 200 for the injector A 32 is thus triggered a predetermined period before the firing of the first cylinder.

The input delayer 224 also applies a signal to a tachometer circuit 226 which generates a signal having a magnitude that is inversely proportional to the rotational velocity of the engine. The output of the tachometer circuit 226 is placed on an RPM bus 228 and is used for a variety of purposes, as explained in greater detail hereinafter.

In operation, the injector timers 200–206 for each of the injectors 32–36 are sequentially triggered a predetermined period before the firing of the spark plug for the cylinder associated with the injector. Synchronism between the operation of the sequencer 216 and the engine is provided by the synchronizing pulse from the spark pulse amplifier 220 for the last cylinder in the firing order. As mentioned above and explained in greater detail hereinafter, the duration of each pulse from the injector timers 200–206 is proportional to the magnitude of the control voltage applied to its control input.

The system illustrated in FIG. 8 also includes a priming system for enriching the mixture either manually or automatically under cold-start conditions. Accordingly, the temperature probe 16 is amplified by a temperature amplifier 230 and applied to a prime timer 232 which, under cold-start conditions, is triggered by a start detector 234. The prime timer 232 may also be triggered by manually actuating a primer switch 236. Triggering the prime timer 232 causes a logic low to be applied to NOR gate 238, thereby enabling pulses present at the other input to NOR gate 238 to be applied simultaneously to all of the NOR gates 208–214. Under these circumstances, the injector timers 200–206 are triggered each time any one of the spark plugs is fired so that the engine receives four times the fuel that it would otherwise receive.

The control signal for determining the duration of the pulses from the injector timers 200–206 is generated in a rather complex manner from a number of sensed operating conditions. A flip-flop 240 is set by the delayed input pulses from input delayer 224 for each firing of the spark plugs. Setting flip-flop 240 allows a reference capacitor 242 to charge at a constant rate, as determined by constant current source 244 which, we shall assume for the present, is fixed. The output of the flip-flop 240 is applied to a low-pass filter 246 which generates an output having a magnitude proportional to the duty cycle of the signal from the flip-flop 240. In other words, flip-flop 240 is set each time a spark plug fires and it is then reset in a manner explained hereinafter. The ratio between the voltage at the output of the low-pass filter 246 and the voltage at the output of flip-flop 240 in the set condition is thus directly proportional to the duty cycle at the output of flip-flop 240. The output of the low-pass filter 246 is then compared by amplifier-integrator 248 to the output of an air mass linearizer 250 which generates a signal indicative of the mass airflow of the induction air. The output of the amplifier-integrator 248 is applied to one input of a comparator 252. Another input of the comparator 252 receives the voltage across the timing capacitor 242. When the voltage on the timing capacitor 242 exceeds the output voltage from the amplifier-integrator 248, the flip-flop 240 is reset, thereby discharging the capacitor 242 and terminating the output of the flip-flop 240. Since the output of the low-pass filter 246 is connected to the inverting terminal of the amplifier-integrator 248, an increase in the duty cycle from flip-flop 240 tends to reduce the output of the amplifier-248. The reduced output from the integrator 248 allows the voltage on timing capacitor 242 to exceed the output voltage from amplifier-integrator 248 sooner, thus reducing the duty cycle of the flip-flop 240. The circuit thus operates as a closed loop, high-gain, negative feedback system to set the duty cycle of the flip-flop 240 to a value determined by the magnitude of the voltage at the output of the air mass linearizer 250. The voltage at the output of the air fuel amplifier-integrator 248 is then automatically adjusted to maintain the duty cycle determined by the linearizer 250 constant. For example, a higher engine rotational velocity increases the rate at which the flip-flop 240 is set. Since the duty cycle of the flip-flop 240 must remain constant, the duration of the pulses from the flip-flop 240 must be reduced in proportion to the increase in setting frequency. The set duration of flip-flop 240 is determined by how quickly capacitor 242 charges to a voltage exceeding the output of amplifier-integrator 248. Assuming that the charge rate of capacitor 242 remains constant, the set duration of flip-flop 240 can only be reduced by reducing the output of amplifier-integrator 248 so that the capacitor 242 is charged to that voltage at an earlier time. Thus the output of amplifier-integrator 248 is inversely proportional to the rotational velocity of the engine. Increasing the duty cycle by increasing the voltage at the output of the linearizer 250 requires that the flipflop 240 generate a pulse having a larger duration. Since the charging rate of the capacitor 242 is assumed to be fixed, the pulse duration can be increased only by increasing the voltage at the output of the air fuel amplifier-integrator 248. The output of amplifier-integrator 248 is thus directly proportional to the mass flow of induction air.

It has heretofore been assumed that the charging rate of the reference capacitor 242 is constant. However, the constant current source 244 charging capacitor 242 generates a current which is indicative of the manifold absolute pressure from amplifier 250 and inversely proportional to the temperature from temperature probe 16. Assuming that the duty cycle of the circuit is constant, a faster charging rate of capacitor 242 requires an increase in the voltage at the output of amplifier integrator 248 in order to maintain the duty cycle constant. The voltage at the output of amplifier-integrator 248 is thus, in part, directly proportional to the manifold absolute pressure and inversely proportional to the engine temperature.

The output of the air-fuel amplifier-integrator 248 is applied to the control inputs of the injector timers 200–206 through a summing network 254 to adjust the duration of the fuel injection in proportion to the output of amplifier-integrator 248.

The summing network 254 also receives the output of a lean burn amplifier 256. Basically, lean burn amplifier 256 produces an output which is inversely proportional to both the rotational velocity and the temperature of the engine in order to enrich the air-fuel mixture when the engine is either cold or running at a low RPM, or the lean burn amplifier 256 has a non-inverting input connected to the RPM bus 228 so that the voltage applied to the non-inverting input through adjusting resistor 258 is inversely proportional to the rotational velocity of the engine. The inverting input of amplifier 256 is connected to the temperature probe 16 so that it receives a voltage which is proportional to the temperature of the engine. Below a predetermined rotational velocity, the voltage applied to the non-inverting input of amplifier 256 is greater than the voltage applied to the inverting input so that the output of amplifier 256 rises as the rotational velocity decreases. This increasing voltage is applied to the control inputs of the injector timers 200–206 through summing network 254 to increase the injection duration as rotational velocity drops. The rotational velocity at which the output of the amplifier 256 becomes positive is determined by the temperature of the engine. The crossover RPM decreases with increasing temperature and may be adjusted with resistor 258.

The output of the summing network 254 is thus a control voltage which is directly proportional to the mass flow of air and the manifold absolute pressure, and inversely proportional to engine rotational velocity and engine temperature. The control voltage from the summing network 254 is also increased when the rotational velocity of the engine is below a predetermined value which is determined by the temperature of the engine. As mentioned above, the control voltage from the summing network 254 controls the duration of the pulses from the injector timers 200–206 and hence the quantity of fuel mixed with the induction air.

The fuel control system of FIG. 8 also includes a fuel safety system for shutting down the electric fuel pump 42 in the event of circuit malfunction. Accordingly, the output of the tachometer 226 is applied to a time-delay circuit 270 which normally maintains a fuel safety relay 272 energized to apply power to the fuel pump 42. In the event that the output of the tachometer 226 does not indicate an engine rotational velocity above a predetermined value for a preset period of time, the time delay circuit 270 deactuates the fuel safety relay 272.

The air mass sensor 22 (FIG. 1) is illustrated in greater detail in FIG. 9. As mentioned above in the explanation of the air mass sensor of FIG. 7, the sense wire 188 has a resistance which is directly proportional to its temperature. It is placed in series with a relatively small resistor 290 arranged in a bridge configuration with resistors 292 and 294. Resistors 292 and 294 have a significantly higher resistance than the wire 188 and resistor 290 so that virtually all of the current flowing through darlington transistor 296 flows through the wire 188. The output of the bridge is applied to a high-gain amplifier 298 having an output which is connected to the base of the darlington transistor 296. The resulting circuit is a negative feedback control circuit which maintains the temperature of the sense wire 188 constant. In other words, as the temperature of the wire 188 goes up, its resistance goes up accordingly. The increase in resistance of wire 188 reduces the voltage applied to the non-inverting input of the amplifier 298, which is reflected in a reduced voltage applied to the base of transistor 296 and a reduced current through transistor 296. Consequently, the flow of current through the wire 188 is reduced, thereby lowering the temperature of the wire 188. The current required to maintain the wire 188 at a preset temperature does, of course, depend upon the amount of heat being removed from the wire by the induction air, and this current is measured by a current-sensing resistor 300. The voltage across resistor 300 thus increases with increasing airflow or increasing mass of the air flowing past the sense wire 188.

The output of the air mass sensor (FIG. 9) is proportional to the mass flow of induction air raised to a power which is less than one. The reason for this characteristic is that heat transfer from an object to a moving airstream is theoretically equal to the square root of the air mass flow. However, because of turbulent airflow and other factors, the theoretical square law characteristics are modified. In the particular embodiment described herein, the heat transferred to the induction air is proportional to the mass flow of induction air raised to the 0.37 power (i.e., mass flow of air is proportional to the heat transfer raised to the 2.69 power). It will be understood, however, that other configurations using the principles described herein will exhibit different modifications from the theoretical square relationship. In order to provide an output which is directly proportional to the mass flow of induction air, an air mass linearizer 250 (FIG. 8) is used to raise the output of the air mass sensor 22 to the 2.69 power. The air mass linearizer 250 is illustrated in further detail in FIG. 10. It is basically composed of operational amplifiers and logging circuits having an output which is an exponential function of its input. The output of the air mass sensor 22 (FIG. 9) is applied to a first operational amplifier 310 through resistor 312. The operational amplifier 310 utilizes a logging circuit 314 for negative feedback so that the output of the operational amplifier 310 is proportional to the logarithm of its input. This output is applied to a second operational amplifier 316 through a second logging circuit 318. The second operational amplifier contains a resistor 320 in its feedback so that its output is a linear multiple of its input. The output of operational amplifier 316 is applied to voltage divider resistors 322,324 which feed back a ratio of 1:2.69 of the output of amplifier 316 to the logging circuit 314. The output of operational amplifier 316 is thus proportional to the input to amplifier 310 raised to the 2.69 power. A third operational amplifier 326, having a gain determined by resistor 328, receives a reference voltage derived from the supply voltage by a circuit which is substantially identical to the logging circuit receiving the input from the air mass sensor 22. The 5-volt supply voltage is applied to operational amplifier 330 through resistor 332. A logging circuit 334 is connected in the negative feedback path of operational amplifier 330, and the output of operational amplifier 330 is applied to output operational amplifier 326 through another logging circuit 336, which adds the output of operational amplifier 316 to the reference circuit. The reference circuit provides good temperature tracking of the linearizer so that the output is stable with respect to changing ambient temperature. As mentioned above, the output of operational amplifier 326 is thus directly proportional to the mass flow of induction air.

The circuitry for detecting the firing of spark plugs for the tachometer and reset circuitry of FIG. 8 is illustrated in FIG. 11. Spark plug firing current is sensed by a toroid or similar sensor 14,18 surrounding spark plug leads 352 extending between the coil and distributor for the tachometer sensor 14 and between the distributor and the spark plug for the last cylinder for the synchronizing sensor 18. The spark plug firing current generates a voltage across windings 354 on the sensor 14,18 which are applied to the gate of an SCR 356. A small capacitor 358 is used as a low-pass filter to prevent inadvertent triggering of the SCR 356. The anode of the SCR 356 is connected to a capacitor (shown hereinafter) which has been charged through a resistor. Consequently, this capacitor is quickly discharged upon the occurrence of a spark plug firing to provide a negative-going waveform to trigger circuitry in the fuel control circuit.

Figure 12A:
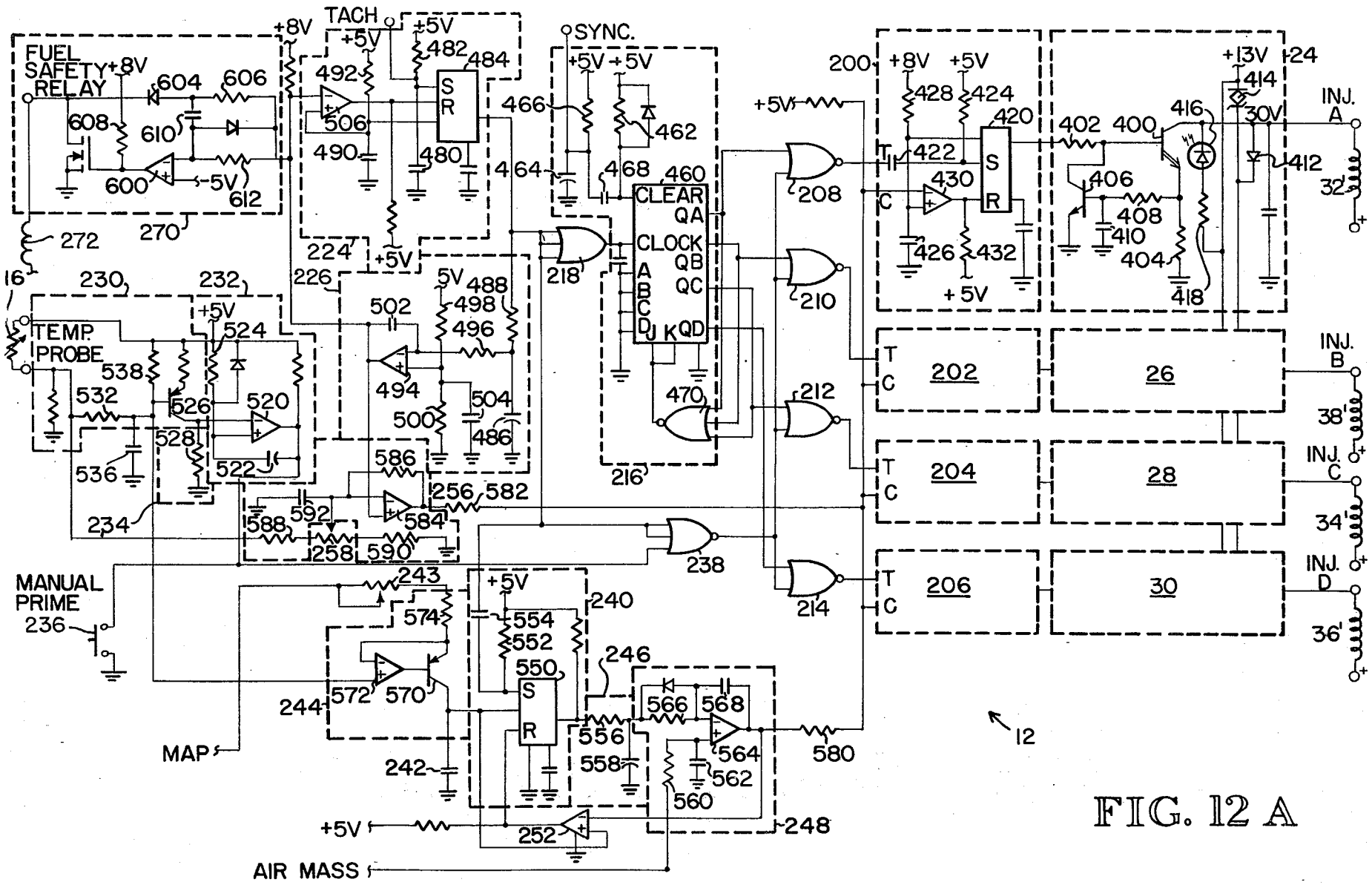
FIG. 12 is a schematic of the fuel control circuit that is illustrated in block diagram form in FIG. 8.

The fuel control circuit 12 is illustrated in FIG. 12A with portions of its circuits numbered identically to the corresponding circuits of FIG. 8. The injector drivers 24–30 are basically constant current sinks which minimize the time required to draw current through the coils 32'–38' in the injectors 32–38, respectively. The input to injector driver 24 is applied to the base of a darlington transistor 400 through dropping resistor 402. A voltage proportional to the current through the darlington transistor 400 is developed across resistor 404, which drives the base of transistor 406 through resistor 408, which, with capacitor 410, forms a low-pass filter. When a voltage is initially applied to the injector driver 24, the inductive reactance of the injector 32 prevents current from immediately flowing through the injector 32. Consequently, the current feedback voltage across resistor 404 is zero, causing transistor 400 to saturate and apply the full supply voltage across the coil 32' of the injector 32. The large voltage across the coil 32' minimizes the turn-on time of the injector 32. As current flows through the injector coil 32', a voltage is developed across resistor 404, which, after a short delay provided by the low-pass filter formed by resistor 408 and capacitor 410, drives transistor 406 out of cutoff. Transistor 406 is connected in a high-gain configuration so that as soon as the base emitter junction of transistor 406 becomes forward biased, the transistor 406 draws substantial current through the dropping resistor 402. The voltage drop through the resistor 402 reduces the voltage applied to the base of the darlington transistor 400 to maintain the current through the injector coil 32' constant.

At the termination of the pulse to the input of injector driver 24, transistor 400 becomes back biased, and a large reverse voltage is developed across the coil 32' as the coil 32' discharges. The discharge path for this current is through diode 412 and a 30-volt zener diode 414. The discharge current does not flow through the discharge path until the reverse voltage has reached at least the 30-volt zener voltage of diode 414, thereby allowing the magnetic field of the coil 32' to collapse much more rapidly in order to insure fast closing of the injector 32. The reduced voltage on the collector of darlington transistor 400 when the injector 32 is being actuated causes current to flow through light-emitting diode 416 and current-limiting resistor 418 to verify the operation of the system.

As mentioned above in reference to FIG. 8, the injector drivers 24–30 are enabled by respective timer circuits 200–206, each having a trigger input and a pulse duration control input. When triggered, the timer circuits 200–206 generate a pulse having a duration determined by the duration control voltage. As illustrated in FIG. 12A, the trigger pulse from NOR gate 208 is applied to the set terminal of timer circuit 420 through capacitor 422. The pulse from NOR gate 208 is negative going, but since the set input to timer 420 is normally held high through resistor 424, the timer 420 is set by the leading edge of the pulse. Upon being set, the timer 420 generates an output signal to the injector driver 24, causing current to flow through the injector coil 32'. Setting of the timer 420 also allows a capacitor 426 to be charged by current flowing through resistor 428. When the capacitor 426 has charged to a voltage greater than the pulse duration control signal, the output of comparator 430, which is normally held high through resistor 432, goes low, thereby resetting the timer 420 and removing the input to the injector driver 24. The time required for the capacitor 426 to charge up to the pulse duration control voltage is, of course, a function of the magnitude of the control voltage. The control voltage thus determines the duration of the pulse applied to the injector driver 24.

The timer circuits 200–206 are, in normal operation, sequentially triggered by negative-going pulses at the output of NOR gates 208–214. The NOR gates 208–214 are, in turn, driven by the sequencer 216. The sequencer 216 includes a conventional shift register 460 having its clear input normally held high through resistor 462. However, firing of the SCR 346 (FIG. 11) of the spark pulse amplifier for the last cylinder in the firing order discharges capacitor 464, which was previously charged through resistor 466. The resulting negative-going pulse is coupled through capacitor 468 to clear the shift register 460 so that the operation of the shift register 460 remains in synchronism with the operation of the engine. NOR gate 470 is provided to decode shifting of a logic high to the fourth output in order to shift a logic high into the first output upon the next clock pulse from NOR gate 218.

The clock pulses driving the shift register 460 through NOR gate 218 are derived by the input delayer 224 from the tach pulses generated by sensor 14 (FIG. 8) each time any of the spark plugs fire. Accordingly, each time the SCR 356 (FIG. 11) in the spark pulse amplifier 222 fires, capacitor 480, which has previously been charged through resistor 482, is discharged, thereby producing a negative-going pulse which sets timer 484. The timer 484 then applies an output to NOR gate 218 which charges capacitor 486 in the tachometer circuit 226 through resistor 488. Setting of the timer 484 also allows capacitor 490 to charge through resistor 492. The voltage on capacitor 486 is applied to the summing junction of operational amplifier 494 through resistor 496. A reference voltage determined by voltage divider resistors 498,500 is applied to the non-inverting input of operational amplifier 494. A capacitor 502, connected in the negative feedback circuit of amplifier 494, causes the amplifier 494 to act as an integrator. Accordingly, the output of amplifier 494 is the integral with respect to time of the difference between the voltage across capacitor 486 and the voltage across capacitor 504 developed by the voltage divider resistors 498,500. The voltage across capacitor 486 is equal to the average voltage from timer 484. Consequently, the voltage on capacitor 486 as a percentage of the set voltage from timer 484 is equal to the duty cycle of timer 484.

The output of amplifier 494 is applied to one input of a comparator 506. The other input of the comparator 506 receives the voltage across capacitor 490. When the capacitor 490 charges through resistor 492 to a voltage greater than the output of integrator 494, the comparator 506 resets the timer 484. The circuit thus functions as a negative feedback circuit to maintain the duty cycle of the timer 484 constant. If the tach pulse rate increases, the duty cycle of the timer 484 also increases, thereby causing the voltage across capacitor 486 to undergo a corresponding increase. The voltage difference applied to the integrator 494 then becomes negative. This voltage difference is integrated, causing the output of integrator 494 to be reduced. The reduced voltage from integrator 494 is applied to comparator 506. The capacitor 490 charges to this reduced voltage quicker so that the timer 484 is reset sooner. Thus an increase in the duty cycle of timer 484 caused by an increase in engine rotational velocity decreases the reference voltage applied to comparator 506 in order to return the duty cycle to a preset value. Similarly, a decrease in the duty cycle of the timer 484 caused by a decrease in engine rotational velocity increases the reference voltage applied to comparator 506 to increase the duty cycle of the timer 484 back to the preset value. The voltage developed by the voltage divider resistors 498,500 is approximately 50 percent of the output voltage of the timer 484 when the timer 484 is set. Thus the duty cycle of the timer 484 is maintained at approximately 50 percent. As the frequency of the pulses applied to the set terminal of the timer 484 varies, the reference voltage from the integrator 494 varies accordingly to maintain the duty cycle at 50 percent. The voltage at the output of the integrator 494 is thus inversely proportional to the rotational velocity of the engine.

It should also be noted that the sequencer 460 is clocked by the low-to-high transition from the output of the NOR gate 218 which occurs when the timer 484 is reset. Since the duty cycle of the timer 484 is 50 percent, the sequencer 460 is clocked midway between sequentially occurring tach pulses regardless of the frequency of the tach pulses. Consequently, the fuel injectors 32–36 are actuated midway between firing of the spark plugs, regardless of the engine rotational velocity. The firing time, of course, can be set to other value by adjusting the voltage applied to the integrator 494 by voltage divider resistors 498,500.

The pulses from the timer 484 are also applied to the NOR gate 238. When the NOR gate 238 is primed, the injector driver circuits 24–30 are triggered each time a spark plug fires so that the fuel processing unit 10 dispenses four times the fuel that it dispenses during normal operation. The NOR gate 238 is enabled by the prime timer 232 upon initially starting the engine while the engine is cold or by actuating the manual prime switch 236. When the manual prime switch 236 is closed, the high-to-low transition applied to the output of comparator 520 pulls the non-inverting input of comparator 520 low through capacitor 522. The output of comparator 520 then goes low, allowing capacitor 522 to charge through resistor 524. The low at the output of comparator 520 enables NOR gate 238 to apply a pulse for each tach pulse to the NOR gates 208–214. When the capacitor 522 charges to a voltage exceeding the voltage applied to the negative input to the comparator 520, the output of comparator 520 goes high, thereby disabling NOR gate 238. The voltage applied to the negative input of comparator 520, and hence the duration of the primer cycle, is determined by the voltage on the collector of transistor 526. This voltage is, in turn, proportional to the current flowing through resistor 528, which is inversely proportional to the voltage applied across resistor 530. The voltage across resistor 530 is, in turn, determined by the voltage applied to the base of transistor 526 through resistor 532 by a voltage divider formed by the temperature probe 16 and resistor 534. The resistance of the temperature probe 16 is inversely proportional to engine temperature so that a low temperature causes a low voltage to be applied to the base of transistor 526, thereby causing a relatively high current to flow resistors 530,528. A relatively high voltage is thus applied to the negative input of comparator 520 so that it requires a relatively long period for the capacitor 522 to charge to this reference voltage. As a result, a lower engine temperature provides a longer priming cycle. A capacitor 536 functions as the start detector 234 (FIG. 8) to initiate a priming cycle when the engine is started. Accordingly, when power is initially applied to the system, the voltage across capacitor 536 is zero, thereby causing a relatively large amount of current to flow through resistor 528. A large reference voltage is then applied to the comparator 520, which results in a relatively long prime cycle. Capacitor 536 then charges through resistor 538 until transistor 526 is cut off, thereby causing the output of comparator 520 to go high.

The pulse duration control signal for the injector timers 200–206 is generated by the air-fuel amplifier-integrator 248, low-pass filter 246, flip-flop circuit 240, comparator 252, reference timing capacitor 242, and constant current source 244, as explained above in reference to FIG. 8. The flip-flop circuit 240 includes a timer 550 having a set input normally held high through resistor 552. The timer 550 is set through capacitor 554 by the pulses from timer 484 midway between firing of the spark plugs. Setting the timer 550 allows capacitor 242 to be charged by constant current source 244. In its set condition, the timer 550 also applies an output to the low-pass filter 246 formed by resistor 556 and capacitor 558. As explained above, the voltage across capacitor 558, as a percentage of timer output voltage, is directly proportional to the duty cycle of the timer 550. This duty cycle voltage is applied to the air-fuel amplifier-integrator 248, which generates an output which is the integral with respect to time of the difference between the air mass sensor output and the duty cycle voltage. More specifically, the air mass sensor output is applied to the low-pass filter formed by resistor 560 and capacitor 562. The voltage across capacitor 562, which is equal to the average mass flow of induction air, is applied to the non-inverting input of an operational amplifier 564. The duty cycle voltage across capacitor 558 is applied to the summing junction of operational amplifier 564 through resistor 566, and a capacitor 568, connected in the negative feedback path of the amplifier 564, causes it to integrate its differential input. The output of the amplifier integrator 564 is applied to one input of the comparator 552 while the other input of the comparator receives the voltage across timing capacitor 242. When the timing capacitor 242 charges to a voltage exceeding the output of amplifier integrator 564, the comparator 252 resets the timer 550.

Assuming for the moment that the current from current source 244 is constant and the mass flow of induction air is constant, it will be seen that the circuit performs in exactly the same manner as the input delayer circuitry 224 and tachometer circuitry 226. The voltage at the output of the amplifier-integrator 564 will automatically change to maintain the duty cycle of the timer 550 constant as the frequency at which the timer 550 is set varies depending upon engine rotational velocity. An increase in engine rotational velocity causes an increase in the frequency at which the timer 550 is set. Consequently, the reference voltage applied by the amplifier integrator 564 to the comparator 252 must be reduced to maintain the duty cycle constant. The output of the amplifier integrator 564 is thus inversely proportional to the rotational velocity of the engine.

Since the reference voltage applied to the amplifier-integrator 564 is proportional to the mass flow of induction air, the duty cycle of the timer 550 increases with the output of the mass flow sensor. An increase in the duty cycle necessitates that the reference voltage at the output of amplifier-integrator 564 increase so that it takes longer for capacitor 242 to charge to the reference voltage. The output of amplifier-integrator 564 is thus directly proportional to the mass flow of induction air.

It has heretofore been assumed that the current from current source 244 is constant. However, current source 244 is composed of a transistor 570, having its base driven by a comparator 572. The input to comparator 572 is, in part, directly proportional to the temperature of the engine so that as the temperature increases, the voltage across resistor 574 decreases. The charging current applied to capacitor 242 is thus inversely proportional to engine temperature. The voltage applied to resistor 574 is, in part, directly proportional to the manifold absolute pressure so that the charging current for capacitor 242 is, in part, directly proportional to manifold absolute pressure. The current for a given temperature and manifold absolute pressure can be adjusted by varying the air-fuel ratio adjustment resistor 243. Assuming that the duty cycle of timer 550 is to remain constant, a larger charging current applied to capacitor requires a higher voltage at the output of amplifier-integrator 564 so that the time required for the capacitor 242 to charge up to the voltage at the output of the amplifier-integrator 564 remains the same. Consequently, the output of the amplifier-integrator 564 is, in part, directly proportional to the manifold absolute pressure and inversely proportional to the engine temperature.

The output of the amplifier-integrator 564 is applied to the pulse duration control circuitry inputs of injector timers 200–206 through summing resistor 580, which forms a part of the summing network 252 (FIG. 8).

The summing network 252 also includes a second summing resistor 582 adding the output of the lean burn amplifier 256 to the output of the air-fuel amplifier-integrator 248. The lean burn amplifier 256 includes an operational amplifier 584 having a gain determined by feedback resistor 586. The output of the temperature probe 16 is applied to the series combination of resistor 588, lean burn adjusting resistor 258, and resistor 590. The lean burn adjusting resistor applies a variable percentage of the temperature signal to a filter capacitor 592 and the noninverting input of operational amplifier of 584. Amplifier 584 thus compares the temperature of the engine to a signal inversely proportional to the rotational velocity of the engine in order to increase the pulse duration control signal applied to the injector timers 200–206 as the rotational velocity of the engine is decreased below a value determined by the temperature of the engine. The air-fuel mixture thus becomes leaner for a given rotational velocity as the engine reaches normal operating temperature, although the mixture will still be enriched by a decrease in rotational velocity of the engine.

The time delay 270 for the fuel safety relay 272 is adapted to initially apply power to the fuel safety relay 272 and maintain power as long as the engine rotational velocity exceeds a predetermined period shortly after startup. The time delay circuit 270 includes a comparator 600 having a 5-volt reference connected to one input and a time delay circuit connected to its other input. Upon system turn-on, field effect transistor 602 turns on, allowing current to flow through the fuel safety relay coil 272 to ground. Diode 604 is maintained in a forward bias condition by current flowing through resistor 606. Consequently, the anode of diode 604 is just slightly above ground potential, and the output of comparator 600 is maintained at a positive voltage through resistor 608. Current from the output of tachometer circuit 226 then charges capacitor 610 through resistor 612. If the engine is not running, the voltage at the output of the tachometer circuit 226 is high, causing the capacitor 610 to charge to above 5-volts after a short delay. At this time, the output of comparator 600 goes low, turning off field effect transistor 602 and preventing the flow of current through the fuel safety relay 272. If the engine has started and the rotational velocity of the engine is above a predetermined value, the output of the tachometer circuit 226 is below the 5-volt reference so that the output of comparator 600 remains high. When the engine rotational velocity falls below a predetermined value, the output of tachometer circuit 226 charges capacitor 610 above the 5-volt reference, thereby cutting off the field effect transistor 602.

The manifold absolute pressure sensor, as illustrated in FIG. 12B, consists of a solid-state, piezo-resistive bridge 700 formed by resistors 702,704,706,708. One side of the silicon substrate is exposed to the engine vacuum. The differential pressure applied to this substrate causes distortion, which imbalances the bridge 700, thereby producing a voltage proportional to the intake manifold pressure. The junction between resistors 702,704 is connected to the noninverting input of one amplifier 710 while the junction between resistors 706,708 is connected to the non-inverting input of a second amplifier 712. Amplifier 712 is arranged as a voltage follower to provide a low-impedance reference point. Amplifier 710 produces an output which is applied through resistor 714 to the base of transistor 716. The output of amplifier 710 is automatically adjusted so that the voltage at the emitter of transistor 716 is approximately equal to the voltage at the junction between resistors 702,704. The output voltage of the bridge 700 is thus applied across resistor 718 so that the current through resistor 718 is proportional to the manifold absolute pressure. The current through resistor 718 is equal to the current through current-sensing resistor 720 so that the manifold absolute pressure output is inversely proportional to the manifold absolute pressure.

The air mass linearizer 250, explained above in reference to FIG. 10, is illustrated in further detail in FIG. 12C. The amplifiers 310,330 each include a filter capacitor 800,802, respectively, in their negative feedback path and respective output resistors 804,806. Logging circuit 314 is formed by transistor 808, logging circuit 318 is formed by transistor 810, logging circuit 334 is formed by transistor 812, and logging circuit 336 is formed by transistor 814. Clamping diodes 816,818 are provided to limit the positive voltage applied to transistors 810,814, respectively. A null potentiometer 820 is adjusted to produce a zero output voltage at zero mass flow of induction air, and gain potentiometer 322 is adjusted to insure that the output is directly proportional to the mass flow of induction air.

I claim:

1. A fuel system for an internal combustion engine, comprising:

a cylindrical conduit receiving induction air through an inlet and having an outlet connected to an intake manifold for said engine;

a butterfly valve mounted in said conduit operatively connected to a throttle for controlling the flow of induction air through said conduit;

a plurality of transducer means for measuring engine operating conditions of temperature, rotational velocity and induction air mass flow of said internal combustion engine, and generating corresponding indicating signals;

control means receiving said indicating signals and generating an injector control signal corresponding to the quantity of fuel to be mixed with said induction air, said injector control signal being a periodically generated pulse having a duration determined by the magnitude of a fuel quantity signal, said fuel quantity signal being generated by a calculator circuit including timer means having a charging input which floats when said timer means is set and is held at a predetermined voltage when said timer means is reset, a timing capacitor connected between the charging input of said timer means and a fixed voltage, trigger means for periodically setting said timer means at a rate which is proportional to the measured rotational velocity of said engine, charging means connected to said timing capacitor for applying a charging current to said timing capacitor which is inversely proportional to the measured temperature of said engine, integrator means for generating as said fuel quantity signal an output signal having a magnitude indicative of the integral with respect to time of the difference between the measured induction air mass flow and the voltage across said timing capacitor, and comparator means connected to said timer means and said integrator means for resetting said timer means responsive to the voltage across said timing capacitor reaching a predetermined percentage of said fuel quantity signal, whereby the magnitude of said fuel quantity signal is automatically adjusted to maintain the duty cycle of said timer means at a value determined by the measured induction air mass flow by varying said fuel quantity signal in inverse proportion to the measured temperature and rotational velocity of said internal combustion engine and in direct proportion to the measured induction air mass flow of said internal combustion engine; and a fuel injector mounted in said conduit receiving pressurized fuel and injecting said fuel into said conduit in response to said injector control signal, said fuel undergoing a pressure drop upon injection sufficient to produce flash vaporization of at least a major part of said fuel, thereby promoting complete combustion of said fuel.

2. The fuel system of claim 1, further including means for increasing the magnitude of said fuel quantity signal as the rotational velocity is reduced below a predetermined value.

3. The fuel system of claim 2 wherein said predetermined value is determined by the temperature of said engine.

4. The fuel system of claim 1, further including primer means for increasing the frequency of said injector control signal for a predetermined period, thereby enriching the air-fuel mixture of said engine.

5. The fuel system of claim 1 wherein one of said engine operating conditions utilized by said control means is a signal indicative of the mass flow of induction air entering said conduit, said signal being generated by a mass flow sensor comprising a sensing element mounted in the flow of said induction air to said conduit so that said induction air removes heat from said sensing element as a function of the mass flow of said induction air, said sensing element being connected to current source means for maintaining the temperature of said sensing element constant and output means for measuring the amount of heat transferred from said sensing element to said induction air responsive to the mass flow rate of said induction air.

6. The fuel system of claim 5 wherein said output means measures the amount of current flowing through said sensing element in order to maintain the temperature of said sensing element relatively constant and provides an output voltage which is proportional to said current.

7. The fuel system of claim 5, further including means for compensating for variations in the temperature of said induction air so that the sensor responds solely to induction air mass flow and not induction air temperature.

8. The fuel system of claim 5 wherein said sensing element is a relatively thin wire extending through said induction airstream so that said sensor rapidly responds to variations in the mass flow of induction air.

9. The fuel system of claim 5 wherein said sensing element has a resistance which is proportional to its temperature, and wherein said output means comprise a voltage divider formed by a series combination of a resistor and said sensing element, said voltage divider being connected in series with said current source and a current sensing resistor, and amplifier means having an input connected to said current source so that variations in the resistance of said sensing element responsive to temperature changes varies the voltage applied to said amplifier means in order to cause said current source to alter the current flowing through said sensing element to return the temperature of said sensing element to a predetermined value whereby the voltage across said current resistor is indicative of the flow of said induction air.

10. The fuel system of claim 9 wherein said voltage divider has a resistance which varies with temperature in the same manner as said sensing element, said resistor being disposed in said induction airstream so that said sensor is nonresponsive to variations in heat transfer from said sensing element caused solely by variations in the temperature of said induction air.

11. The fuel system of claim 5 wherein the output of said output means is proportional to the mass flow of induction air raised to a predetermined power, said system further including linearizer means for raising the output of said output means to the reciprocal of said predetermined power so that said linearizer generates an output which is proportional to the mass flow of induction air.

12. The fuel system of claim 1 wherein the operation of said butterfly valve is controlled by the rotation of a control shaft, and wherein said system further includes a linkage for connecting a manually actuatable throttle member to said control shaft, comprising:

a first link member projecting from said control shaft in a first direction;

a second, rotatably mounted link member projecting from a rotational axis in a direction perpendicual to said first direction and toward the radially outer end of said first link member;

a third link member having opposite ends pivotally secured to the respective radially outer ends of said first and second link members so that said third link member is tangent to the rotational path of the outer end of said first link member; and a fourth link member connected to said second link member at a tangent to the rotational path of the outer end of said second link member, whereby the rate of rotation of said first link member responsive to rotation of said second link member is initially relatively low but increases with rotation of said second link member.

13. A fuel system for an internal combustion engine, comprising:

a cylindrical conduit receiving induction air through an inlet and having an outlet connected to an intake manifold for said engine;

a butterfly valve mounted in said conduit operatively connected to a throttle for controlling the flow of induction air through said conduit;

means for measuring engine operating conditions of temperature, rotational velocity and induction air mass flow of said internal combustion engine;

means for generating indicating signals corresponding to the measured temperature and induction air mass flow of said engine;

means for generating an indicating signal corresponding to the rotational velocity of said engine, including (a) timer means having a timing capacitor and a charging resistor, said timer means generating an output and allowing current to flow through said charging resistor into said timing capacitor upon being set and terminating said output and discharging said capacitor upon being reset, (b) trigger means for periodically setting said timer means at a rate which is proportional to the measure rotational velocity of said engine, (c) integrator means for generating a set duration control signal having a magnitude indicative of the integral with respect to time of the difference between the output of said timer means and a duty cycle reference signal, and (d) comparator means connected to said timing capacitor and said integrator means for resetting said timer means responsive to said timing capacitor being charged to a voltage exceeding said set duration control signal so that the duty cycle of the output of said timer means is a fixed value determined by said duty cycle reference signal, and the magnitude of said set duration control signal varies responsive to variations in the measured rotational velocity of said engine to vary the set period of said timer means in order to maintain the duty cycle of said timer means constant, whereby said set duration control signal provides an indication of the rotational velocity of said engine;

control means receiving said indicating signals and generating an injector control signal corresponding to the quantity of fuel to be mixed with said induction air; and a fuel injector mounted in said conduit receiving pressurized fuel and injecting said fuel into said conduit in response to said injector control signal, said fuel undergoing a pressure drop upon injection sufficient to produce flash vaporization of at least a major part of said fuel, thereby promoting complete combustion of said fuel.

14. The fuel system of claim 13 wherein said set duration control signal is inversely proportional to the rotational velocity of said engine, said system further including fuel shutoff means comprising second comparator means for comparing said set duration control signal to a second reference signal and for allowing fuel to flow to said injector when the magnitude of said set duration control signal exceeds the magnitude of said reference signal, whereby fuel is prevented from flowing to said injector when the rotational velocity of said engine falls below a predetermined value for a preset period of time.

* * * * *